United States Patent [19]

Terasaka et al.

[11] Patent Number: 4,712,529

[45] Date of Patent: Dec. 15, 1987

[54] AIR-FUEL RATIO CONTROL FOR TRANSIENT MODES OF INTERNAL COMBUSTION ENGINE OPERATION

[75] Inventors: Katsunori Terasaka, Yokosuka; Hiroshi Sunbuichi; Toyoaki Nakagawa, both of Yokohama, all of Japan

[73] Assignee: Nissan Motor Co., Ltd., Yokohama, Japan

[21] Appl. No.: 1,441

[22] Filed: Jan. 8, 1987

[30] Foreign Application Priority Data

Jan. 13, 1986 [JP] Japan ..... 61-5838

[51] Int. Cl.[4] ..... F02D 41/10

[52] U.S. Cl. ..... 123/492; 123/488; 123/489

[58] Field of Search ..... 123/478, 480, 486, 488, 123/489, 492, 493, 494

[56] References Cited

U.S. PATENT DOCUMENTS 4,227,507 10/1980 Takase et al. ..... 123/492
4,487,190 12/1984 Isobe ..... 123/492
4,512,318 4/1985 Ito et al. ..... 123/492
4,528,964 7/1985 Kashiwaya et al. ..... 123/492
4,562,814 1/1986 Abo et al. ..... 123/492 X
4,630,206 12/1986 Amamo et al. ..... 123/492 X

OTHER PUBLICATIONS

Matsushita et al, "Development of the Toyota Lean Combustion System", published in Nainen Kikan", vol. 23, Oct. 1984, pp. 33–40.

*Primary Examiner*—Willis R. Wolfe

*Attorney, Agent, or Firm*—Schwartz, Jeffery, Schwaab, MacK, Blumenthal & Evans

[57] ABSTRACT

The outputs generated by the throttle position sensor and the pressure responsive type air flow sensor (or alternatively a flap type air flow meter or the like) are used to generate correction factors which when combined permit the correction of the air flow sensor output for a short period following the initiation of a demand for engine acceleration to obviate the discrepency between the actual and indicated air flows and thus improve the real-time control of the air-fuel ratio (A/F) of the mixture and the level of emission control and performance of the engine.

6 Claims, 7 Drawing Figures

AIR-FUEL RATIO CONTROL FOR TRANSIENT MODES OF INTERNAL COMBUSTION ENGINE OPERATION

BACKGROUND OF THE INVENTION

1. Field of the Invention

The present invention relates generally to an internal combustion engine and more specifically to an induction sensor arrangement which enables improved A/F control.

2. Description of the Prior Art

A previously proposed air-fuel ratio (A/F) control system for an internal combustion engine has been disclosed in an article entitled 'Development of the Toyota Lean Combustion System' published in 'NAINENN KIKAN' vol. 23 October 104 issue on pages 33 to 40. This system has been developed to enable control the A/F of the air-fuel mixture charged into the cylinders of the engine over a wide range spanning approximately stoichiometric to lean mixtures. To initially determine the amount of fuel which needs to be injected per cylinder, the output of an induction pressure sensor is used to sense how much air is being inducted into the engine. Subsequently, to complete the A/F control a specially developed air-fuel ratio sensor capable of sensing air-fuel ratios up until super lean mixtures are reached, is used.

In this system because the amount of fuel is supplied to the engine varies with the load thereon it is necessary to correct the output of the pressure sensor before using the same in the appropriate calculation or calculations. However, a problem is encountered in that, even though the effect of the pressure wave characteristics which occur in the induction system are anticipated and the pressure sensor constructed in a manner designed to compensate for the same, under given circumstances such as a sudden demand for acceleration the correlation between the sensor output and the actual air flow temporarily deteriorates.

As shown in FIG. 1, in the event that acceleration is required and the throttle valve opened quickly and the amount of air which is permitted to flow to the cylinders of the engine increased, the output of the pressure sensor does not increase for a period of 25–40 ms (by way of example) and thus does not accurately indicate the amount of air actually flowing through the system at that time. During this brief period as the amount of fuel being injected is determined in a microprocessor based on the output of the pressure sensor at or prior the beginning of the induction phase, the temporary discrepency between the actual amount of air entering the engine cylinders and that which is indicated by the pressure sensor results in the injection of insufficient fuel, the formation of an extremely lean mixture and a series of succesive misfires. This causes the engine to 'stumble' increases the emission levels and deteriorates the driveability of the same undesirably.

In the event that the output of a flap type air flow sensor is used in place of the pressure sensor to sense the amount of air being inducted a similar problem is encountered. Viz., as shown in FIG. 1 for approximately 20 ms the output of the device remains unchanged and thereafter tends to undergo an increase which is far more rapid than the actual air flow increase (viz., overshoot). This tends to induce sudden leaning of the air-fuel mixture followed by an over enrichment thereof.

SUMMARY OF THE INVENTION

It is an object of the present invention to provide a system which combines the outputs generated by the throttle position sensor and the pressure responsive type air flow sensor (or alternatively a flap type air flow meter or the like) in manner which permits the correction of the air flow sensor output for a short period following the initiation of a demand for engine acceleration or the like and thus improve the real-time control of the air-fuel ratio (A/F) of the mixture and thus improve the level of emission control and performance of the engine.

In brief, the above object is achieved by an arrangement wherein first and second correction factors are derived and added together. During periods when no change in pressure is detected or during actual non-transitory operation, the value of correction factors are inherently reduced to zero. This permits the same type of calculation to be conducted under all modes of engine operation.

More specifically, a first aspect of the present invention take the form of a method of operating an internal combustion engine which is characterized by the steps of: sensing a parameter which varies with the amount of air being inducted into a cylinder of the engine and producing a first signal indicative thereof; detecting a parameter which varies with the throttling of the induction system and producing a second signal indicative thereof; monitoring the second signal to sense the initiation of transitory engine operation; determing a first correction value by: (i) modifing the change in the second signal with respect to engine speed, and (ii) modifying a value indicative of the amount of air being inducted into the cylinder at the instant that the initiation of the transitory operation is detected with the value derived by modifying the change in the second signal with respect to engine speed; determining a second correction value by adding a value derived by multiplying (a) the change in the first signal by a factor which varies with engine speed by (b) the instant value of the first signal; and summing the first and second correction values to derive an accurate approximation of the air being inducted into the cylinder.

A further aspect of the invention comes in the form of an internal combustion engine which features: means for sensing a parameter which varies with the amount of air being inducted into a cylinder of the engine and producing a first signal indicative thereof; means for detecting a parameter which varies with the throttling of the induction system and producing a second signal indicative thereof; means for monitoring the second signal to sense the initiation of transitory engine operation and determining a first correction value by: (i) modifing the change in the second signal with respect to engine speed, and (ii) modifying a value indicative of the amount of air being inducted into the cylinder at the instant that the initiation of the transitory operation is detected with the value derived by modifying the change in the second signal with respect to engine speed; determing a second correction value by adding a value derived by multiplying (a) the change in the first signal by a factor which varies with engine speed by (b) the instant value of the first signal; and summing the first and second correction values to derive an accurate approximation of the air being inducted into the cylinder.

DETAILED DESCRIPTION OF THE PREFERRED EMBODIMENTS

Figure 2:
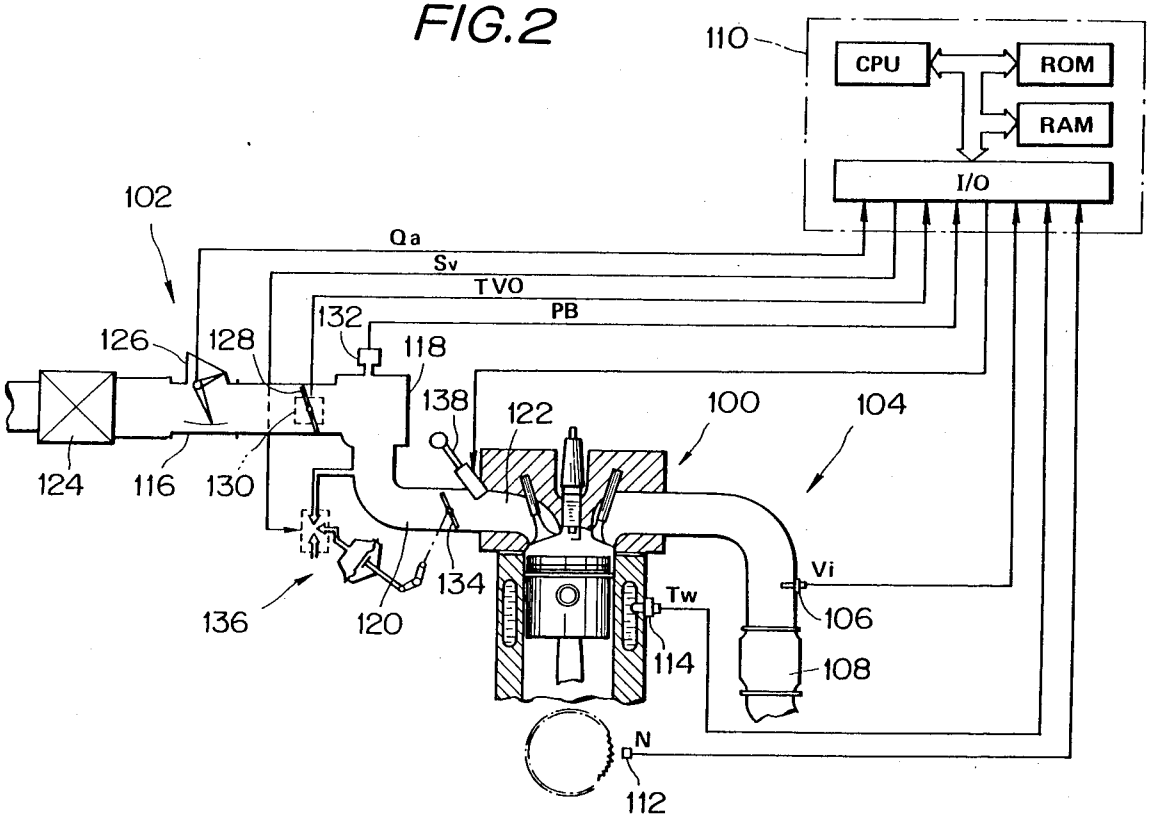
FIG. 2 shows in schematic form an engine system to which the embodiments of the present invention are applied.

FIG. 2 shows an engine system to which the embodiments of the present invention are applied. In this arrangement the numeral 100 denotes an internal combustion engine which is equipped with an induction system generally denoted by 102 and exhaust system generally denoted by 104. The exhaust system includes an air-fuel ratio sensor 106 which in this instance takes the form of an oxygen sensor of the type which exhibits a marked change in output voltage at the stoichiometric A/F value. Located downstream of the $O_2$ sensor is a 'three-way' catalytic converter 108 (viz., a unit which is capable of simultaneously reducing the emission levels of CO, HC and NOx). The output Vi of the $O_2$ sensor 106 is fed to the I/O interface of a microprocessor which forms the heart of a control circuit 110.

Although not shown, it will be appreciated that the output of the $O_2$ sensor 106 is suitably A/D converted prior supply to the I/O interface.

The output (signal N) of a crank angle sensor 112 and that of an engine coolant temperature sensor 114 (signal Tw) are similarly supplied to the microprocessor via the I/O. In the case these sensors produce analog signals then A/D conversion is carried out in a manner similar to that performed in connection with the analog sigal produced by the $O_2$ sensor.

The induction system 102 includes an induction manifold comprised of a induction passage 116, collector section 118 and branch runners 120. The branch runners lead from the collector 118 to the respective inlet ports 122 of the engine. An air cleaner 124 and a flap type air flow sensor 126 are disposed at the upstream end of the induction passage 116. The air flow meter 126 is arranged to generate a signal Qa representative of the amount of air passing therethrough. This signal is supplied to the I/O interface of the microprocessor in digitized form.

A throttle valve 128 is disposed in the induction passage upstream of the collector section 118. A throttle valve position sensor 130 is operatively connected with the throttle valve 128 and arranged to output a signal TVO indicative of the opening degree thereof. This signal is digitized and supplied to the control circuit as shown.

An induction pressure sensor 132 is arranged to be responsive to the pressure prevailing in the collector section 118 and output a signal PB indicative thereof to the I/O interface the control unit microprocessor.

A swirl control valve 134 is disposed in each of the branch runners 120 immediately upstream of the intake ports 122 formed in the engine cylinder head and arranged to control the flow of air entering the respective combustion chambers in a manner to promote a suitable swirl therein. A swirl control valve servo mechanism 136 is operatively connected with each of the swirl valves 134 and arranged to control the positions thereof in response to a control signal Sv issued by the control unit 110. An example of a swirl generating arrangement can be found in copending U.S. patent application Ser. No. 848,565 filed on Apr. 7, 1986 in the name of Nakajima et al now U.S. Pat. No. 4,651,693. The content of this application is hereby incorporated by reference thereto.

Fuel injectors 138 (one in each branch runner) are arranged to inject fuel toward the the downstream end of the respective intake ports 122. The injectors 138 are controlled by signals Si issued by the control unit 110.

Although not specifically illustrated the ignition timing of the engine is also controlled by the control unit 110.

The ROM of the microprocessor contains control programs which control the operation of the engine fuel injectors 138, ignition system and swirl control arrangement in response to the data inputted from the various sensors of the system.

Figure 1:
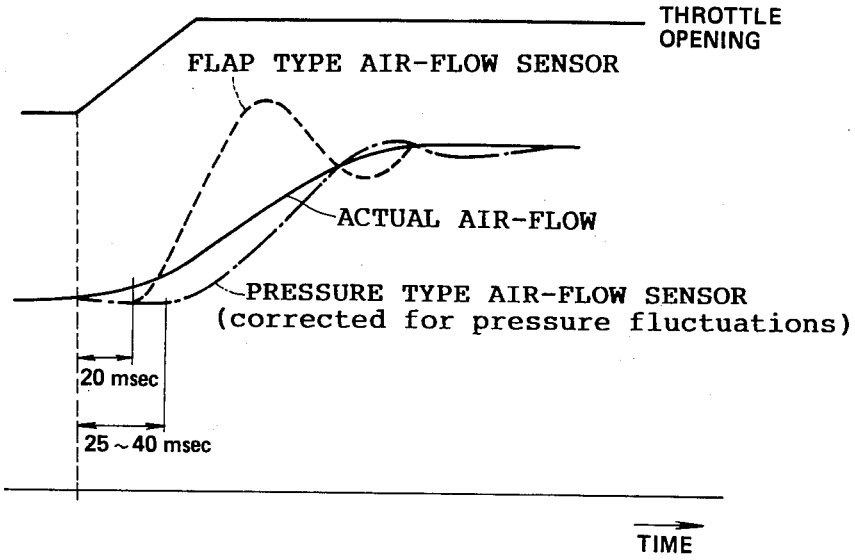
FIG. 1 is a graph showing, in terms of throttle opening and time, the output characteristics of pressure type and flap type air flow sensors which occur in response to sudden changes in the opening degree of the engine throttle valve such as occur upon sudden demands for engine acceleration.
Figure 3:
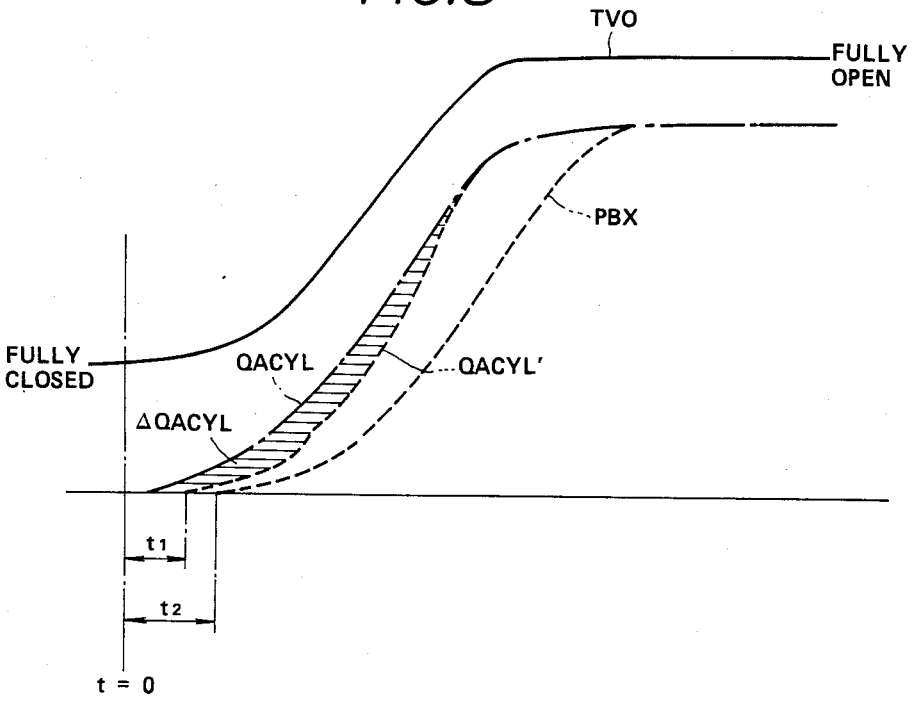
FIG. 3 is a graph showing, in terms of throttle opening degree and time, the technique which is employed to effect the correction which characterizes the present invention.

In order to develop an understanding of principles on which the correction of the air flow according to the present invention is based reference is made to FIG. 3 wherein trace PBX denotes the output of the pressure sensor after suitable electronic modification (e.g. smoothing) to eliminate the effects of the pressure waves which inevitably are produced in the induction system, trace TVO the actual position of the throttle valve as sensed by sensor and QACYL the actual amount of air which is inducted into each cylinder in response to the throttle valve movement.

As will be apparent from this figure, up until time $t_2$ the level of signal PBX does not exhibit any change. During this period the difference between the indicated flow and the actual flow is denoted by only the hatched area ΔQACYL.

Figure 4:
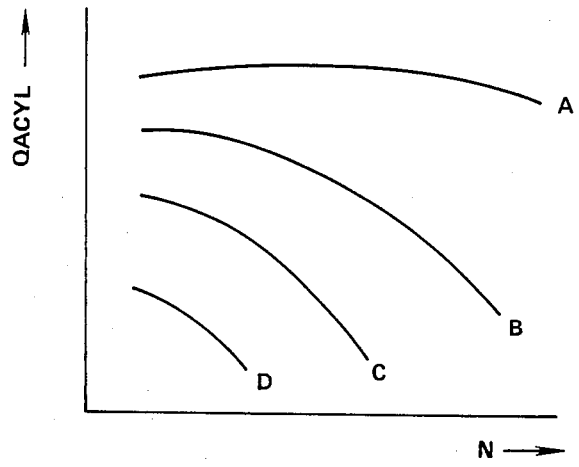
FIG. 4 is a graph showing, in terms of induction flow and engine speed, the effect of throttle opening on the change in the amount of air which is inducted into each cylinder.
Figure 5:
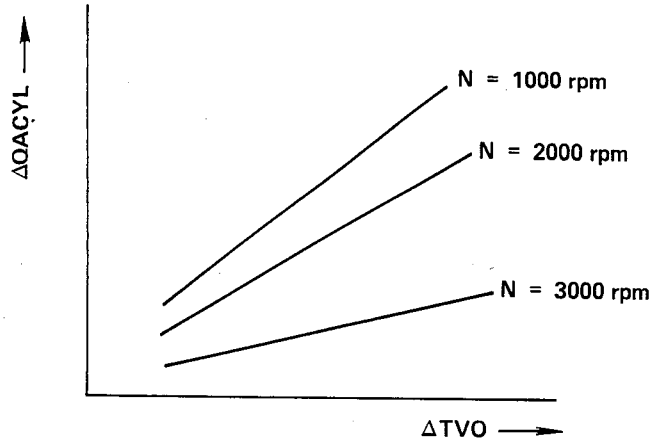
FIG. 5 is a graph showing, in terms of one of two correction factors used in the present invention and the change in throttle position sensor output the effect of engine speed on the amount of air which is inducted into the engine cylinders.
Figure 6:
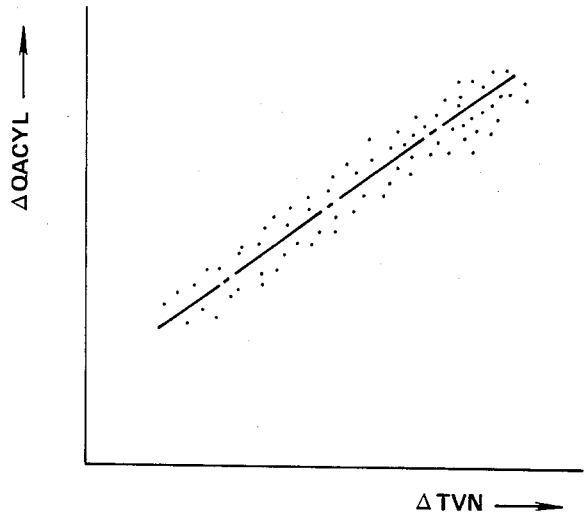
FIG. 6 is a graph which demonstrates that if the throttle position signal is modified with respect to engine speed then an essentially linear relationship is developed with respect to the above mentioned connection factor.

In order to calculate this value experiments were conducted and the data contained in FIGS. 4 to 6 logged.

FIG. 4 shows the effect of engine speed (N) on the amount of air inducted into the cylinders of the engine (QACYL) for given throttle openings. As will be appreciated no noticeable effect is induced by throttle openings greater than that corresponding to trace A while below this setting (Viz., traces B to D) a noticeable reduction in the amount of air inducted occurs with increase in engine speed.

On the other hand, FIG. 5 shows the change in ΔQACYL produced by a change in the throttle position ΔTVO for a plurality of selected engine speeds. As will be appreciated from this data the effect of throttle opening on induction volume reduces with engine speed.

From this data it is clear that ΔTVO cannot be relied upon to provide reliable correction. To overcome this a value ΔTVN is developed:

$$\Delta TVN = \Delta TVO \times Nint \quad (1)$$

wherein Nint: denotes the time required for one phase of engine operation for the instant set of operating conditions.

In a four cycle engine one phase of engine operation occurs essentially each 180° of crankshaft rotation. Thus, Nint is approximately equal to 1/N wherein N denotes the rotational speed of the engine. Accordingly, it is possible to substitute this value in equation (1) as follows:

$$\Delta TVN = \Delta TVO / N \quad (2)$$

From FIG. 6 it is clear that if ΔTVN and ΔQACYL are plotted against each other then essentially linear relationship is developed.

Accordingly, to calculate the correction required for the hatched section the following equation provides a good correlation with experimental data.

$$\Delta QACYL = \Delta TVN \times INTQA \quad (3)$$

wherein INTQA: is the induction volume as sensed at the instant that the transient phase of operation is initiated.

However, from time t2 the discrepency between the actual air flow and that indicated by signal PBX deviates beyond the ΔQACYL correction factor. To bridge this gap it is necessary to boost the value of PBX. To this end the following equation is used.

$$QACYL' = PBX + \alpha \Delta PB \quad (4)$$

wherein $\alpha$ is an engine speed dependent coefficient

Thus by summing the values of QACYL' and ΔQACYL a good correlation the actual volume of air inducted −QACYL is achieved. Viz:

$$QACYL = \Delta QACYL + QACYL' \quad (5)$$

When the throttle valve movement diminishes to approximately zero and/or while $t_1$ is less than $t_2$ (i.e. stops in a new position) then the value of ΔPB becomes zero reducing the value of ΔQACYL to zero. When ΔPB becomes zero the the value of QACYL becomes equal to PBX and thus the equation holds for all modes of operation (viz., holds for the initial period of transitory operation and for steady state operation.

Figure 7:
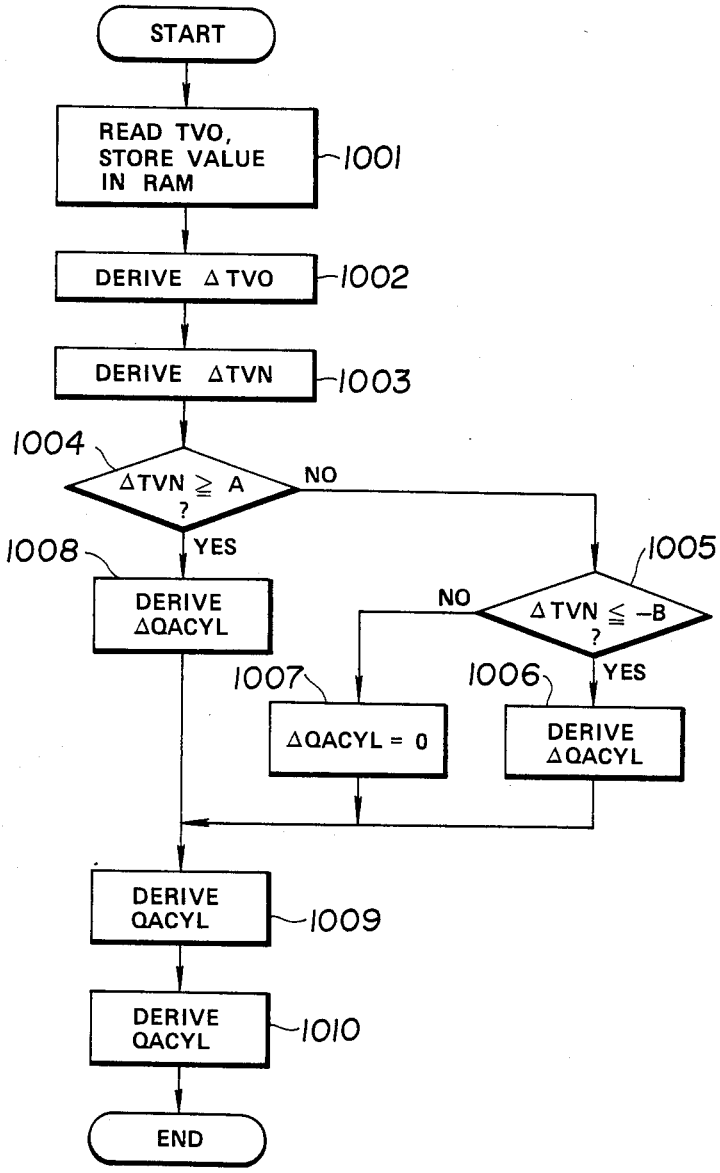
FIG. 7 is a flow chart showing the steps which characterize the operation of a first embodiment of the present invention.

FIG. 7 shows in flow chart form a program which is run at predetermined intervals (e.g. 5 ms) to implement the above calculations.

As shown, the first step (1001) of this program is to read the output of the throttle valve position sensor and and set this value in RAM. At step 1002 the difference in throttle valve position (ΔTVO) is determined. This may be done by subtracting the instant value of TVO from that scored in RAM during the previous run of the program. At step 1003 the value of ΔTVN is derived using equation (2).

At step 1004 the value of ΔTVN is compared with a predetermined value A. In the event that ΔTVN is not equal to or greater than A (A>0) the program flows to step 1005 wherein the value of ΔTVN is compared with a second predetermined value −B (B>0). Viz., ΔTVN is ranged with respect to the predetermined values A to −B. The reason for this ranging is found in the data contained in FIGS. 4 to 6. Viz., From these figures it is clear that at large throttle settings and engine speeds the effect which need be compensated for, decreases.

In the event that the result of the inquiry conducted at step 1005 reveals that the instant value of ΔTVN is equal or lower than −B then the program goes to step 1006 wherein ΔQACYL is derived utilizing equation (3). On the other hand, if the value is found to be greater than −B then at step 1007 the value of ΔQACYL is set to zero.

If the outcome of step 1004 reveals that the instant value of ΔTVN is greater than A then the program goes to step 1008 wherein ΔQACYL is derived.

At step 1009 QACYL' is derived using equation (4) and at step 1010 the values of QACYL' and ΔQACYL are summed to derive a very close approximation of the instant induction volume QACYL.

It will be noted that during non-transitory operation that the output of the air flow meter 126 can be used to indicate the amount of air being inducted into the system. Thus, if desired the value of INTQA can be taken from the output of this sensor at the moment that transitory operation is detected.

In order to calculate the amount of fuel which need be injected to produce the required air-fuel ratio (A/F) for the instant set of operating conditions the value derived in step 1010 is used in the following equation:

$$Tin = QACYL \times KMR \times COEF \times ALPHA + Ts \quad (6)$$

wherein

Tin: is the pulse width of the injection signal required under the instant set of operational circumstances;

KMR: is a target A/F indicating factor (converts to F/A) which is derived in response to the instant engine load, speed etc.;

COEF: denotes the total effect of a plurality of coefficients which effect the time required for the fuel to reach the combustion chamber. This value includes KAS, KACC, KDEC, etc., which relate the to effect of the wetting of the induction port walls, the evaporation of the fuel, the influence of engine temperature, engine start-up, warm-up, idling, etc.,;

ALPHA: is a coefficient which relates to the delay encountered with feed-back control from the air-fuel ratio sensor disposed in the exhaust system; and Ts: the voltage rise time which must be added to the injection pulse width to allow for the mechanical delay inherent in the fuel injectors.

In addition to the air-fuel ratio control the present invention renders improved ignition timing and swirl control possible by accurately controlling the air-fuel ratio and thus avoiding the use of a spark timing suitable for a richer mixture than is actually formed in the cylinders and vice versa and which avoids producing a swirl rate unsuited for the instant air-fuel mixture.

It should be noted that the use of the instant invention is not limited to the use of a pressure sensor for its implementation and that other types such hot wire vortex sensors and the like may be utilized.

What is claimed is:

1. A method of operating an internal combustion engine comprising the steps of:

sensing a parameter which varies with the amount of air being inducted into a cylinder of the engine and producing a first signal indicative thereof;

detecting a parameter which varies with the throttling of the induction system and producing a second signal indicative thereof;

monitoring said second signal to sense the initiation of transitory engine operation;

determining a first correction value by:

(i) modifing the change in said second signal with respect to engine speed, and (ii) modifying a value indicative of the amount of air being inducted into the cylinder at the instant that the initiation of said transitory operation is detected with the value derived by modifying the change in said second signal with respect to engine speed;

determing a second correction value by adding a value derived by multiplying (a) the change in said first signal by a factor which varies with engine speed by (b) the instant value of said first signal; and summing the first and second correction values to derive an accurate approximation of the air being inducted into the cylinder.

2. A method as claimed in claim 1 further comprising the step of:

using the sum of said first and second correction values to determined a fuel supply control parameter by (a) multiplying the sum with (i) an air-fuel ratio target indicating factor; and (ii) a factor which varies with the wetting and evaporation in the induction system of the engine between the site of supply and the cylinder; and (b) adding thereto a factor indicative of the time required to actually supply fuel into said induction system following a command to do so.

3. A method as claimed in claim 2 further comprising the steps of:

sensing a parameter which varies with the air-fuel ratio of the air-fuel mixture combusted in the cylinder and producing a third signal indicative thereof;

producing a value indicative of the delay between combustion and the generation of said third signal; and multiplying the sum with the delay indicating value before adding the factor indicative of the time required to actually supply fuel subsequent to a command to do so.

4. In an internal combustion engine means for sensing a parameter which varies with the amount of air being inducted into a cylinder of the engine and producing a first signal indicative thereof;

means for detecting a parameter which varies with the throttling of the induction system and producing a second signal indicative thereof;

means for monitoring said second signal to sense the initiation of transitory engine operation and determining a first correction value by:

(i) modifing the change in said second signal with respect to engine speed, and (ii) modifying a value indicative of the amount of air being inducted into the cylinder at the instant that the initiation of said transitory operation is detected with the value derived by modifying the change in said second signal with respect to engine speed;

determining a second correction value by adding a value derived by multiplying (a) the change in said first signal by a factor which varies with engine speed by (b) the instant value of said first signal; and summing the first and second correction values to derive an accurate approximation of the air being inducted into the cylinder.

5. An engine as claimed in claim 4 wherein said monitoring means further includes circuitry for:

using the sum of said first and second correction values to determine a fuel supply control parameter by:

multiplying the sum with (i) an air-fuel ratio target indicating factor;

(ii) a factor which varies with the wetting and evaporation in the induction system of the engine between the site of supply and the cylinder; and adding thereto a factor indicative of the time required to actually supply fuel into said induction system following a command to do so.

6. An engine as claimed in claim 5 further comprising:

means for sensing a parameter which varies with the air-fuel ratio of the air-fuel mixture combusted in the cylinder and producing a third signal indicative thereof;

and wherein said monitoring means includes circuitry for:

producing a value indicative of the delay between combustion and the generation of said third signal; and multiplying the sum with the delay indicating value before adding the factor indicative of the time required to actually supply fuel subsequent to a command to do so.

* * * * *